US006499473B2

(12) United States Patent
Itoh

(10) Patent No.: US 6,499,473 B2
(45) Date of Patent: Dec. 31, 2002

(54) INTAKE MANIFOLD OF OUTBOARD MOTOR

(75) Inventor: Jun Itoh, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/867,461

(22) Filed: May 31, 2001

(65) Prior Publication Data

US 2001/0047802 A1 Dec. 6, 2001

(30) Foreign Application Priority Data

May 31, 2000 (JP) ..... 2000-162602

(51) Int. Cl.[7] ..... F02M 35/04
(52) U.S. Cl. ..... 123/585; 123/184.61
(58) Field of Search ..... 123/585, 184.61, 123/184.24, 184.34, 184.42; 137/314

(56) References Cited

U.S. PATENT DOCUMENTS 4,132,194 A * 1/1979 Saito ..... 123/32 A
5,325,828 A * 7/1994 Yamaguchi et al. ..... 123/308
6,142,842 A * 11/2000 Watanabe et al. ..... 440/88

OTHER PUBLICATIONS

U.S. patent application Ser. No. 09/867,461, filed May 31, 2001, pending.
U.S. patent application Ser. No. 09/867,468, filed May 31, 2001, pending.

* cited by examiner

*Primary Examiner*—Paul J. Hirsch
(74) *Attorney, Agent, or Firm*—Oblon, Spivak, McClelland, Maier & Neustadt, P.C.

(57) ABSTRACT

An outboard motor is mounted with a multiple-cylinder engine having cylinders to which intake air is distributed through the intake manifold unit of an intake unit, respectively. The intake manifold unit comprises an intake manifold body formed of a synthetic resin, an idling air control (IAC) valve for regulating a quantity of intake air into the intake manifold unit in an idling operation state, a valve holder to which the IAC valve is operatively connected in a floating manner, and an elastic member through which the IAC valve is mounted to the valve holder. The IAC valve, the elastic member and the valve holder are coupled integrally with each other and mounted to the intake manifold body in the floating state.

9 Claims, 11 Drawing Sheets

INTAKE MANIFOLD OF OUTBOARD MOTOR

BACKGROUND OF THE INVENTION

The present invention relates to an intake manifold of an outboard motor.

An outboard motor includes a multiple-cylinder engine provided with an intake manifold unit (which will be called merely intake manifold or manifold, hereinlater) for distributing intake air, the flow of which is regulated by a throttle body, to the respective cylinders of the engine. Such an intake manifold is normally made of aluminum alloy. However, this time, an intake manifold having a portion downstream of a throttle body, which is made of synthetic resin, has been considered and adopted for an outboard motor for the first time by the applicant of the subject application.

Some intake manifolds are provided with IAC (idling air control) valve (which may be designated as an ISC (idling speed control valve)) for regulating a quantity of intake air when a throttle valve arranged in a throttle body is closed (i.e. during an idling state). The IAC valve is normally attached to the intake manifold through a valve holder made of sheet metal.

The intake manifold is also provided with a by-pass passage for regulating the quantity of air flowing through the IAC valve. A union made of brass is press-fit into an air inlet of the by-pass passage to reduce intake noise and to prevent the entry of seawater or the like into the intake manifold.

Moreover, in order to measure the interior pressure of the intake manifold, a pressure sampling (takeout) hole for sampling pressure is formed so as to communicate with a pressure sensor through a hose.

However, if an intake manifold made of resin is used and a sheet metal holder is used to attach the IAC valve to an intake manifold body, the edge portion of the holder contacts the surface of the intake manifold body and scrapes the resin surface thereof, thus being inconvenient.

Furthermore, in many cases, the IAC valve is fixed in a semi-floating state by an elastic element such as rubber. Due to this fact, depending on a state in which the IAC valve is attached, the IAC valve may contact an attachment bolt and the operating vibration of the IAC valve may be propagated to the intake manifold. Since such vibration tends to be easily propagated to the resin intake manifold, the vibration may cause the generation of noise.

Furthermore, it is undesirable to press-fit the brass union into the air inlet of the by-pass passage because of the disadvantageous increase in the number of parts and the increase in the number of assembling steps.

In a case where a pressure sampling hole for measuring internal pressure is formed in the intake manifold and connected to the pressure sensor through a hose, it is necessary to provide some filter means on the intake manifold so as to prevent fuel or lubricant from entering the intake manifold. This undesirably increases the number or parts and requires providing screws or the like to the intake manifold so as to attach such a filter means thereto.

SUMMARY OF THE INVENTION

An object of the present invention is to eliminate defects or drawbacks encountered in the prior art mentioned above and to provide an outboard motor intake manifold capable of reducing noise and improving assembling performance without increasing the number of parts and the number of assembling and working steps. A further object of the invention is to improve the reliability and durability of the intake manifold.

This and other objects of the present invention can be achieved by providing an intake manifold unit for an outboard motor mounting of a multiple-cylinder engine having cylinders to which intake air is distributed through the intake manifold unit, the intake manifold unit comprising:

- an intake manifold body formed of a synthetic resin;
- an idling air control (IAC) valve for regulating a quantity of intake air into the intake manifold body in an idling operation state;
- a valve holder to which the IAC valve is operatively connected in a floating manner; and
- an elastic member through which the IAC valve is mounted to the valve holder, the IAC valve, the elastic member and the valve holder being coupled integrally with each other and mounted to the intake manifold body in the floating state.

In a preferred embodiment of this aspect, the intake manifold body comprises a surge tank disposed on the downstream side of a throttle body of the intake unit and a branch extending from the surge tank and operatively connected to the engine, the surge tank being provided with a valve mounting boss to which the valve holder is mounted.

The IAC valve is provided with a flanged portion, the elastic member is composed of first and second rubbers between which the flanged portion is clamped and to which the valve holder made of metal plate is mounted in the floating manner.

The intake manifold body is formed with a pressure sampling hole, to which a pressure hose connection union is mounted, and the pressure hose connection union is operatively connected to a pressure sensor for an outboard motor in a manner that an axis of the pressure sampling hole is arranged to be offset from an axis of a passage formed in this union.

The intake manifold body is provided with a by-pass passage regulating a quantity of air flowing in the IAC valve, the by-pass passage being provided with an inlet formed so as to provide a funnel shape expanding outward, and a hood-shaped protrusion which is integrally formed above the inlet of the by-pass passage.

The intake manifold body is formed to be dividable into inside and outside shells and further provided with a valve silencer for the IAC valve, the valve silencer being divided into halves, which are integrally formed with divided inside and outside shells of the intake manifold unit, respectively. This provides an expansion chamber when the divided portions of the intake manifold body are coupled with each other.

According to the present invention of the structures mentioned above, the following advantageous functions and effects will be attained.

The outboard motor of the present invention mounts a multiple-cylinder engine having an intake manifold that distributes intake air to respective cylinders of the engine and is formed of synthetic resin, and has an IAC valve for regulating a quantity of intake air into the intake manifold in an idling state which is attached to a valve holder through an elastic element in a full floating state. Thus, the IAC valve, the elastic element and the valve holder are integrally formed with one another. The IAC valve, the elastic element and the valve holder thus integrated can be attached to the intake manifold body. Thus, the operating vibration of the IAC valve can be absorbed to thereby prevent the generation of noise in the intake manifold body, and assembling performance for assembling the parts relating to the IAC valve can be improved.

Further, a pressure sampling hole is formed in the intake manifold, and a pressure hose connection union is provided at the pressure sampling hole to connect the pressure sampling hole to a pressure sensor. An axis of the pressure sampling hole is arranged so as to be offset from an axis of a passage formed in the pressure hose connection union. Thus, it is possible to prevent fuel and lubricant from entering the pressure sensor and to reduce the number of parts and the number of assembling steps.

Moreover, according to the present invention, the by-pass passage regulating a quantity of air flowing in the IAC valve is provided for the intake manifold, an inlet of the by-pass passage is formed into a funnel shape expanding outward, and a hood-shape protrusion is integrally formed above the inlet of the by-pass passage. Accordingly, it is possible to reduce intake air noise and to prevent seawater from entering the inlet of the manifold.

Furthermore, the intake manifold is formed to be dividable, and a valve silencer for the IAC valve is formed to the intake manifold. The valve silencer is divided into halves and the respective halves are integrally formed with halves divided from the divided intake manifold to thereby form the intake manifold with an expansion chamber. Thus, it is possible to reduce the number of parts and the number of assembly steps.

The nature and further characteristic features will be made more clear from the following descriptions made with reference to the accompanying drawings.

DESCRIPTION OF THE PREFERRED EMBODIMENT

A preferred embodiment of the present invention will be described hereunder with reference to the accompanying drawings.

Figure 1:
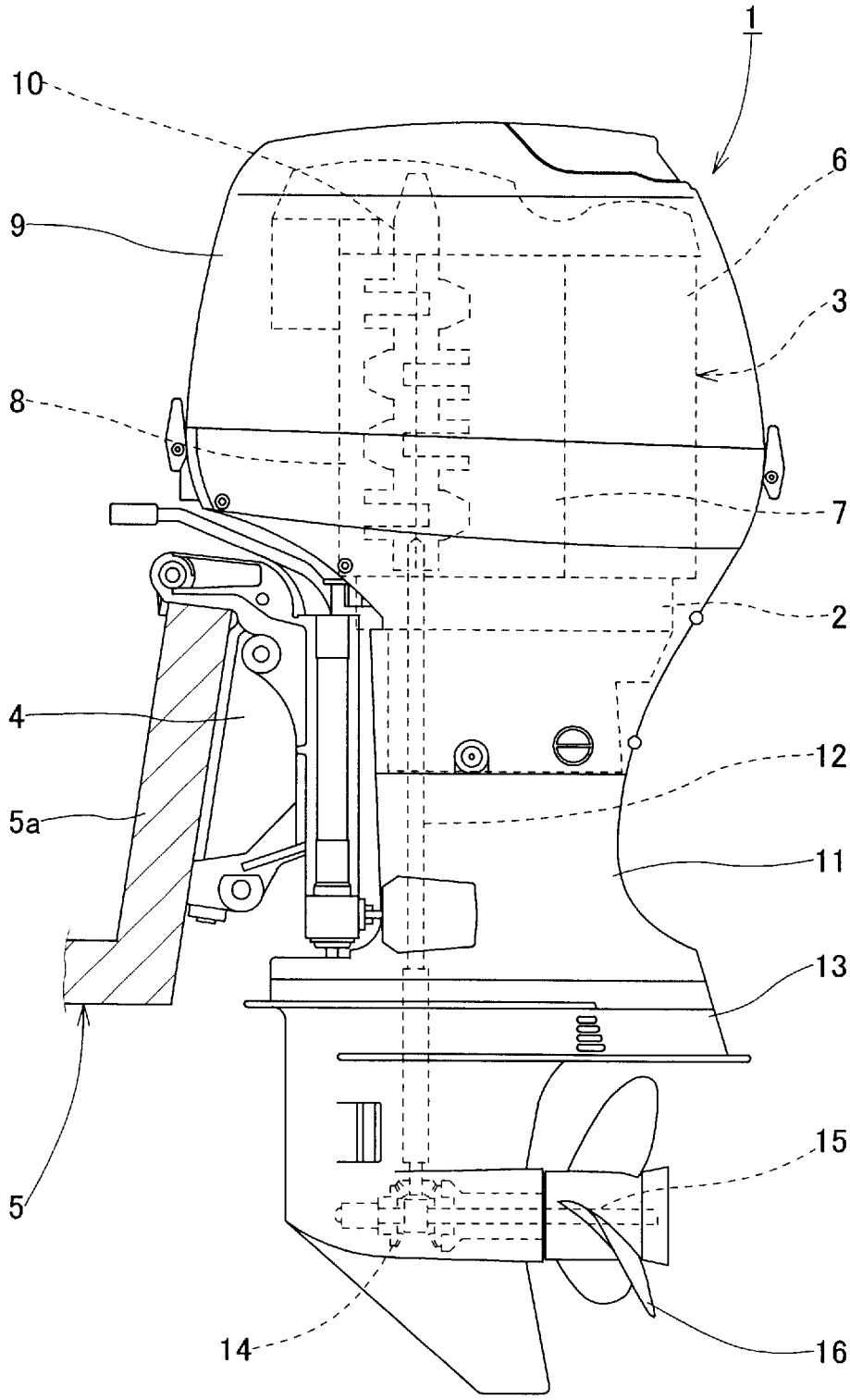
FIG. 1 is a left side view of an outboard motor provided with an outboard motor intake manifold according to one embodiment of the present invention.

FIG. 1 is a left side view of an outboard motor 1 to which the present invention is applied. As shown in FIG. 1, the outboard motor 1 is provided with an engine holder 2 and an engine 3 is disposed above the engine holder 2. A clamp bracket 4 is attached to the engine holder 2 and the outboard motor 1 is installed to the transom 5*a* of a hull 5, for example.

Figure 2:
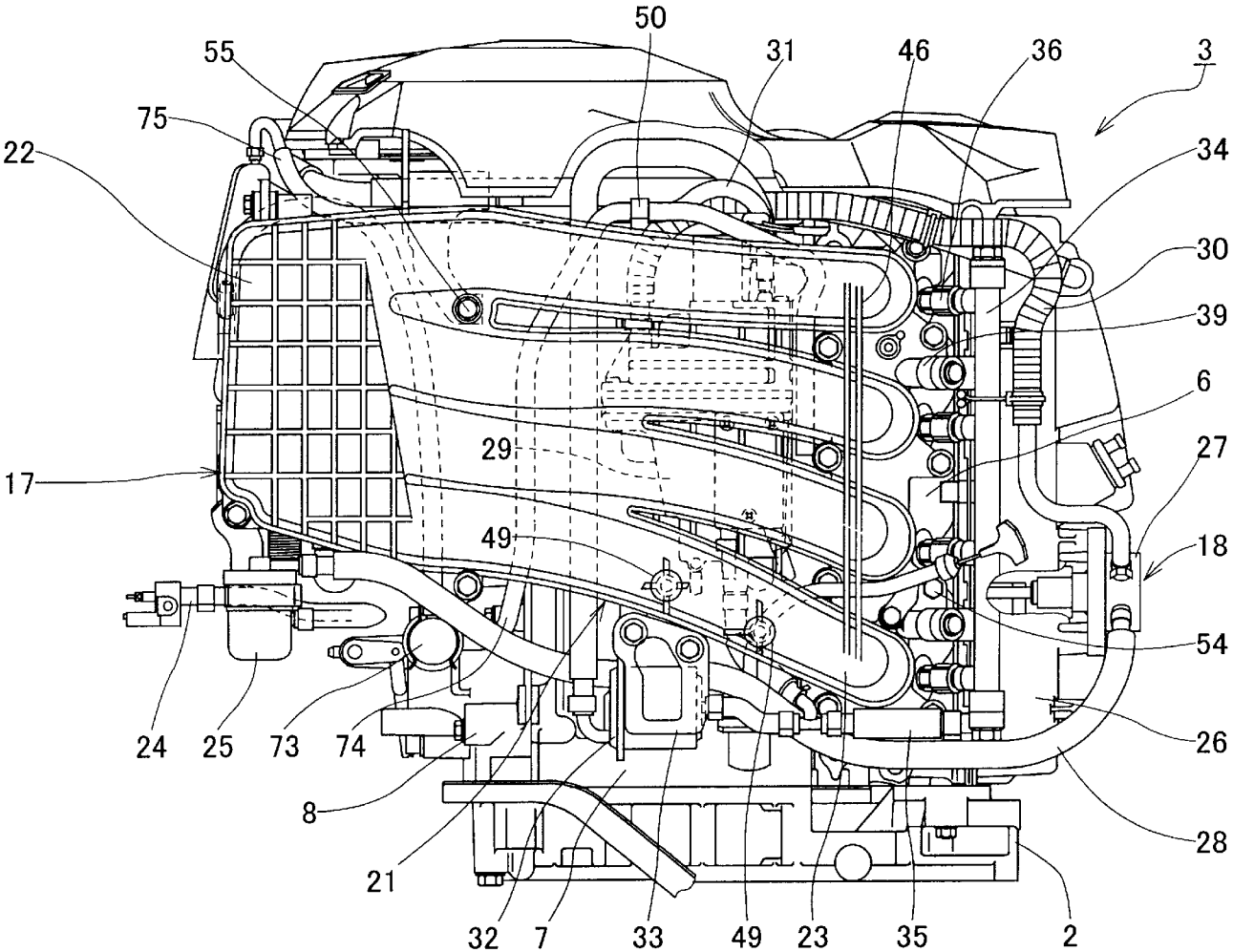
FIG. 2 is a side view of an engine, in an enlarged scale.
Figure 3:
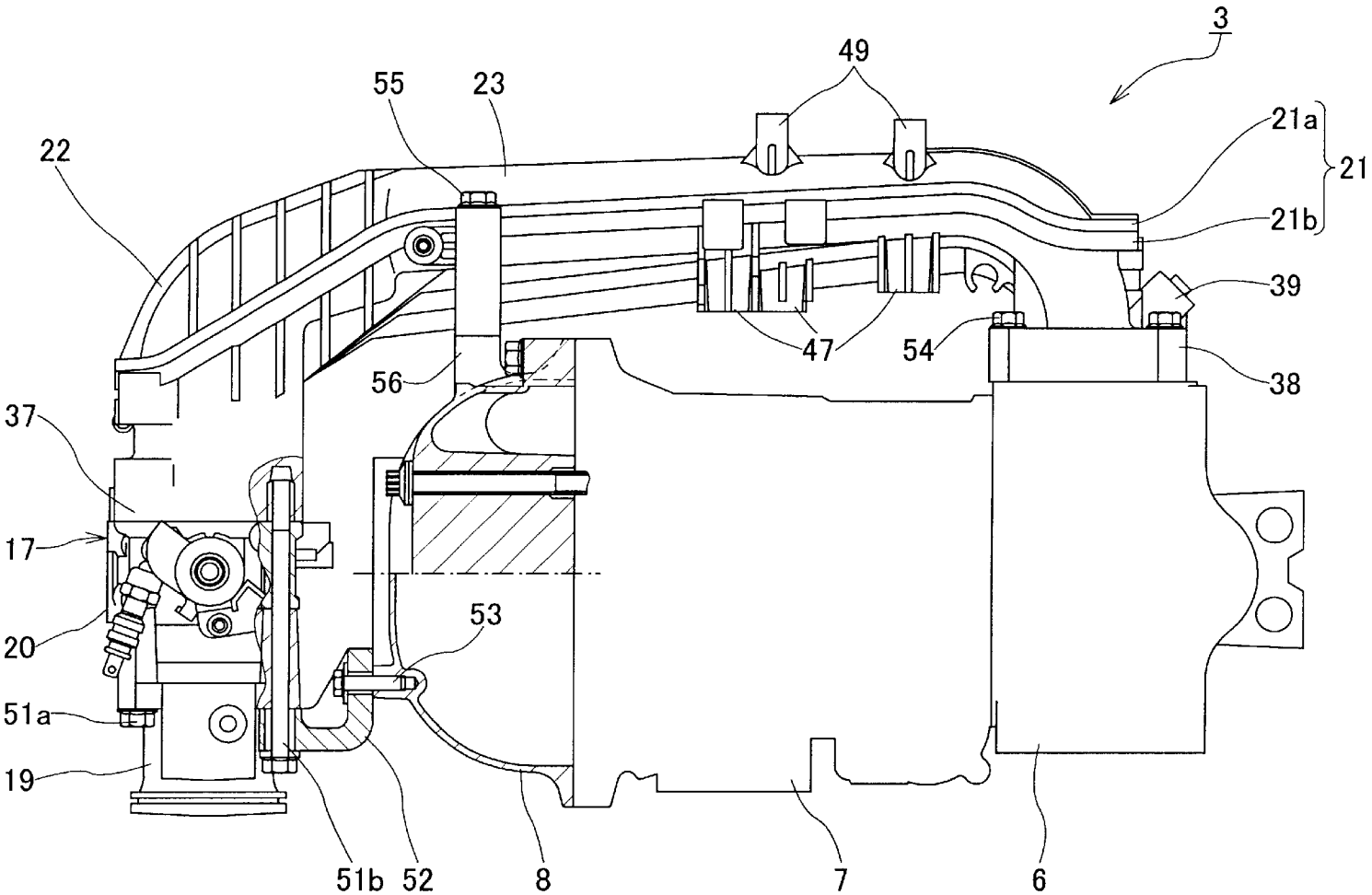
FIG. 3 is a bottom view of the engine.

FIG. 2 is an enlarged view of the engine 3. FIG. 3 is a bottom view of the engine 3. As shown in FIGS. 1, 2 and 3, the engine 3 mounted on the outboard motor 1 is, for example, a water-cooled four-stroke-cycle in-line four-cylinder engine. The engine 3 is constituted in combination with a cylinder head 6, a cylinder block 7, a crankcase 8, etc. Further, as shown in FIG. 1, the surrounding of the engine 3 is covered with an outboard motor cover 9.

The cylinder block 7 is arranged to a rear side (right side as viewed in FIGS. 1, 2 and 3) of the crankcase 8 arranged in the forefront of the engine 3 (left side as viewed). The cylinder head 6 is arranged to a rear portion of the cylinder block 7. A crankshaft 10 is arranged almost perpendicularly at a connecting portion between the crankcase 8 and the cylinder block 7 (see FIG. 1).

As shown in FIG. 1, a drive shaft 12 is provided below the engine 3. A drive shaft 12 has a structure in which the upper end portion of the drive shaft 12 is fitted into the lower end portion of the crankshaft 10 through, for example, a spline connection, the drive shaft 12 extends downward in the drive shaft housing 11 and drives a propeller 16 through a bevel gear 14 and a propeller shaft 15 in a gear case 13 provided below the drive shaft housing 11.

Electrical equipment, not shown, an intake system 17 and a fuel supply system 18 are arranged around the engine 3. The intake system 17 mainly consists of a silencer 19, a throttle body 20 and an intake manifold 21. The intake manifold 21 includes an intake manifold body (which will be called merely intake manifold hereinlater), a surge tank 22 and four branches 23 extending from the surge tank 22 to the respective cylinders.

The throttle body 20 which is one of the constitutional elements of the intake system 17 is arranged, for example, in front of the crankcase 8. The silencer 19 and the surge tank 22 of the intake manifold 21 are connected to the upstream and downstream sides of the throttle body 20, respectively. The branches 23 extending from the surge tank 22 are arranged almost horizontally on the side of the cylinder block 7 in vertical alignment and connected to respective intake ports, not shown, formed at the cylinder head 6.

The outboard motor 1 of this embodiment is provided with a fuel tank, not shown, on the hull 5 side. A fuel supply hose 24 extending from the fuel tank is connected to a low-pressure fuel filter 25. A low pressure fuel pump 27 driven by a cam shaft, not shown, which is a constitutional element of a valve system of the engine 3, is arranged on a cylinder head cover 26 covering the rear portion of the cylinder head 6. The low-pressure fuel pump 27 and the low-pressure fuel filter 25 are connected to each other through a low-pressure fuel hose 28.

A vapor separator 29 is provided in a space formed between the left side surface of the cylinder block 7 and the intake manifold 21. The vapor separator 29 separates fuel steam contained in liquid fuel such as gasoline and releases or returns only this steam in the air or to the intake system 17. The fuel is introduced from the low-pressure fuel pump 27 to the vapor separator 29 through the low-pressure fuel hose 30.

A high-pressure fuel pump, not shown, is provided in the vapor separator 29. The steam-separated fuel is forcedly fed from the high-pressure fuel pump to a high-pressure fuel filter 32 through a high-pressure fuel hose 31. This high-pressure fuel filter 32 is fixed to the lower portion of the intake manifold 21 through, for example, a bracket 33.

The high pressure fuel forcedly fed to the high pressure fuel filter 32 is fed to a delivery pipe 34 which is integrated with or integrally attached to the intake manifold 21, as will be described hereinlater, through a high pressure fuel hose 35. The delivery pipe 34 is connected to fuel injectors 36 attached to the respective cylinders. These fuel injectors 36 inject high-pressure fuel into the intake ports.

With reference to FIGS. 4 to 7, the intake manifold 21 is formed of synthetic resin. Further, as indicated by arrows, the intake manifold 21 is divided into two segments in a lateral direction (in a state that the manifold 21 is attached to the engine 3), that is, into an outside shell 21*a* and an inside shell 21*b* along the flow direction of intake air flowing in the branches 23.

The outside shell 21*a* and the inside shell 21*b* are formed through an injection process, and the shells 21*a* and 21*b* are coupled, at their mating surfaces, to and integrated with each other through a vibration welding method. A mounting eye 37 for mounting the throttle body 20 is formed integrally with the surge tank 22 formed upstream of the intake manifold 21. Another mounting eye 38 for mounting the engine 3 is formed integrally with the downstream ends of the branches 23 formed downstream of the intake manifold 21. The mounting eye 38 for the engine 3 extends longitudinally so as to couple the downstream ends of the respective branches 23 and a mounting boss 39 for mounting the delivery pipe 34 is formed integrally with the mounting eye 38. The delivery pipe 34 is directly fixed to the mounting boss 39.

A plurality of reinforcement ribs 46 extending almost orthogonally to the axes of the branches 23, i.e., in the longitudinal direction, are formed integrally with the inside shell 21*b* on the engine side surface of the inside shell 21*b* so as to couple the branches 23 with one another. Furthermore, mounting bosses 47 for fixing the vapor separator 29 are provided on the engine side surface of the inside shell 21*b* and the vapor separator 29 is fixed to these mounting bosses 47 by, for example, means of bolts 48.

Figure 4:
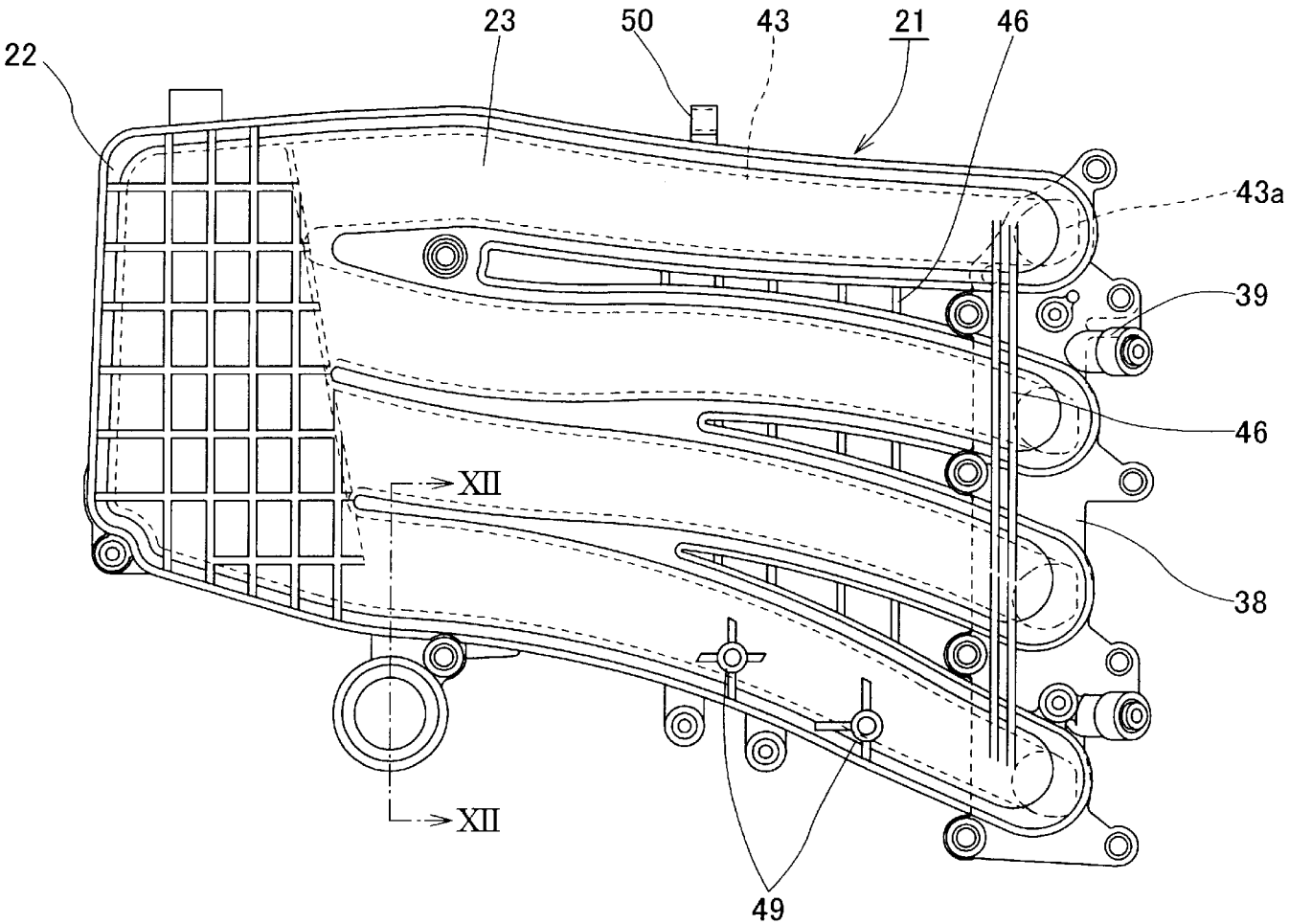
FIG. 4 is a left side view of only the intake manifold in a state mounted to the engine.
Figure 5:
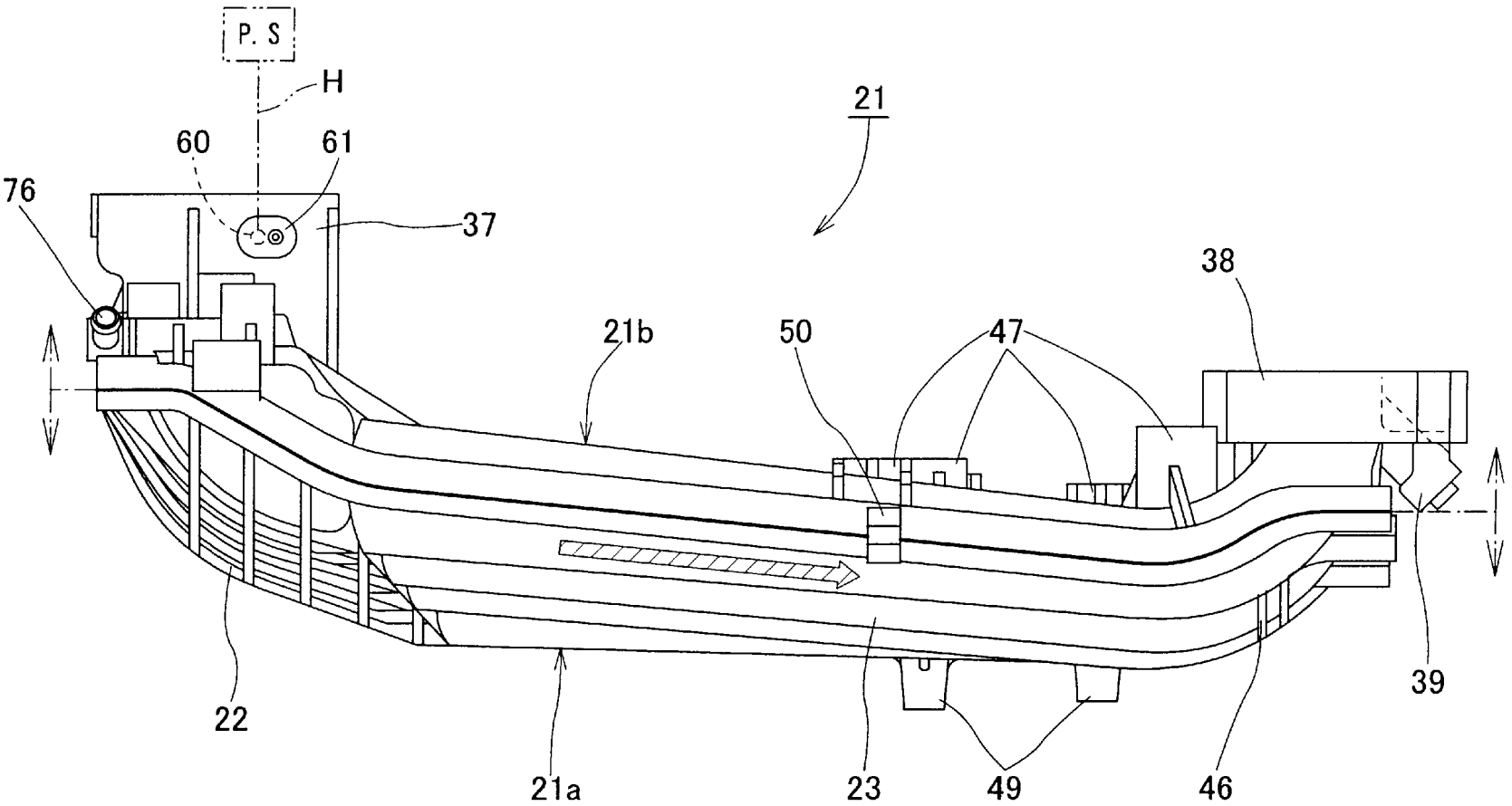
FIG. 5 is a top view of only the intake manifold.

As shown in FIGS. 4 and 5, reinforcement ribs 46 are also formed on the surface of the outside shell 21*a* opposite to the engine 3 and a plurality of supporting bosses 49 for mounting the outboard motor 1 to be laid sideways are provided integrally with the outside shell 21*a* on substantially the central lower portion of this opposite surface.

As shown in FIG. 3, the silencer 19, the throttle body 20 and the surge tank 22 of the intake manifold 21 are integrated with one another by a plurality of bolts 51*a* and 51*b*. The intake system 17, which includes a plurality of constitutional elements integrated with one another, is attached to, for example, the crankcase 8 of the engine 3 by another bolt 53 through a bracket 52. At this time, the bracket 52 is fastened to the intake system 17 by the bolt 51*a* for integrating the constitutional elements of the intake system 17.

Further, as shown in FIGS. 2 and 3, the mounting eye 38 formed on the downstream ends of the branches 23 for the engine 3 is directly fixed to the cylinder head 6 by means of bolts 54. In addition, upper and lower portions on the upstream sides of the branches 23 are directly fixed to bosses 56 provided at the crankcase 8 by means of bolts 55.

Meanwhile, the outboard motor 1 is provided with a pressure sensor P.S to measure the internal pressure of the intake manifold 21. As shown in FIG. 5, the pressure sampling hole 60 formed on the upper surface of the mounting eye 37 of the surge tank 22 for mounting the throttle body 20 and the pressure sensor P.S are coupled to each other through a pressure hose H.

Figure 8:
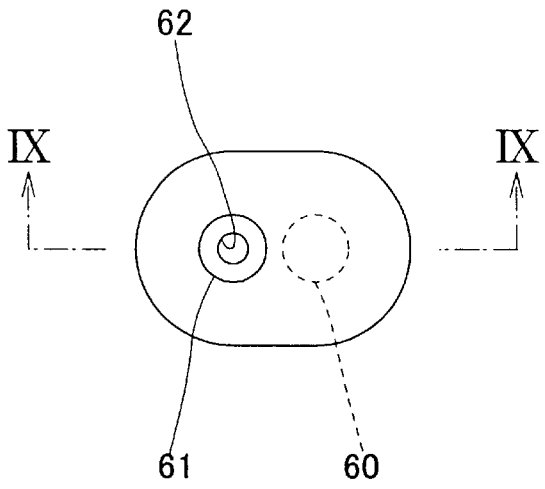
FIG. 8 is an enlarged plan view of a pressure sampling hole.
Figure 9:
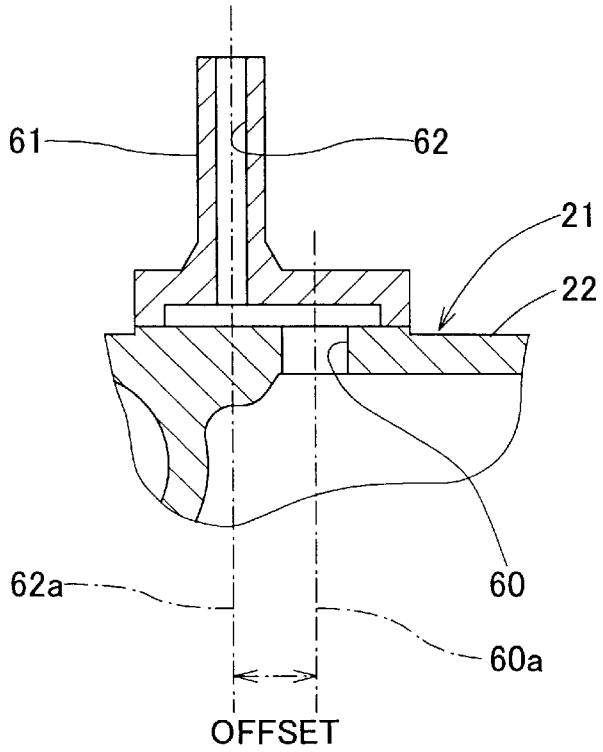
FIG. 9 is a sectional view taken along the line IX—IX of FIG. 8.

FIG. 8 is an enlarged plan view of the pressure sampling hole 60. FIG. 9 is a sectional view taken along the line IX—IX of FIG. 8. As shown in FIGS. 8 and 9, a pressure hose connection union 61 is welded to the pressure sampling hole 60 from an external side. A passage 62 formed in the union 61 and the pressure sampling hole 60 are arranged so that the respective axes 60*a* and 62*a* thereof are offset from each other.

Figure 7:
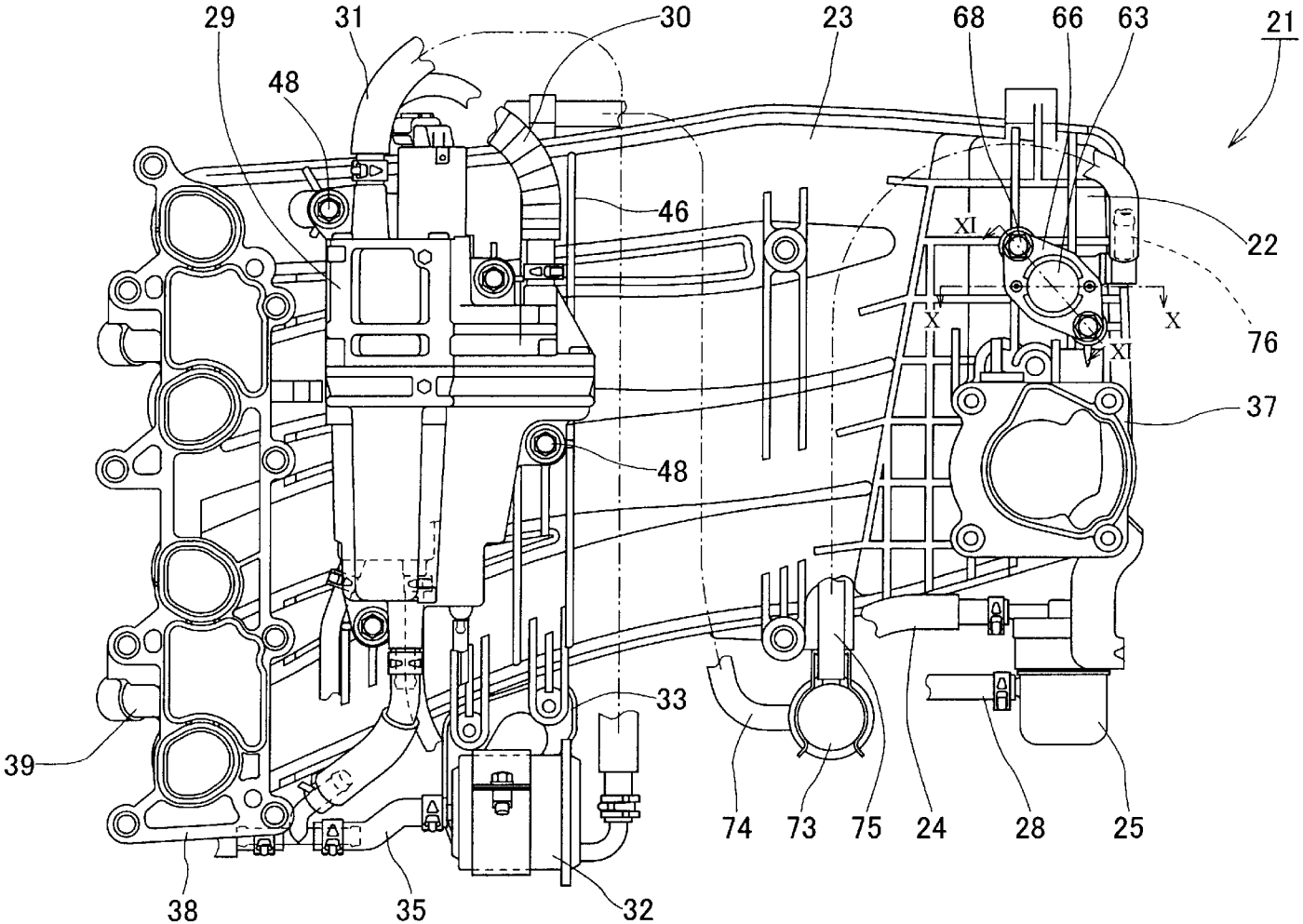
FIG. 7 is a night side view of only the intake manifold to which a part of a fuel supply system is mounted.

Further, as shown in FIG. 7, the intake manifold 21 is provided with an idling air control (IAC) valve 63 for regulating the quantity of intake air when a throttle valve, not shown, in the throttle body 20 is closed (or in an idling state). The IAC valve 63 may be designated as ISC (idling speed control) valve.

Figure 10:
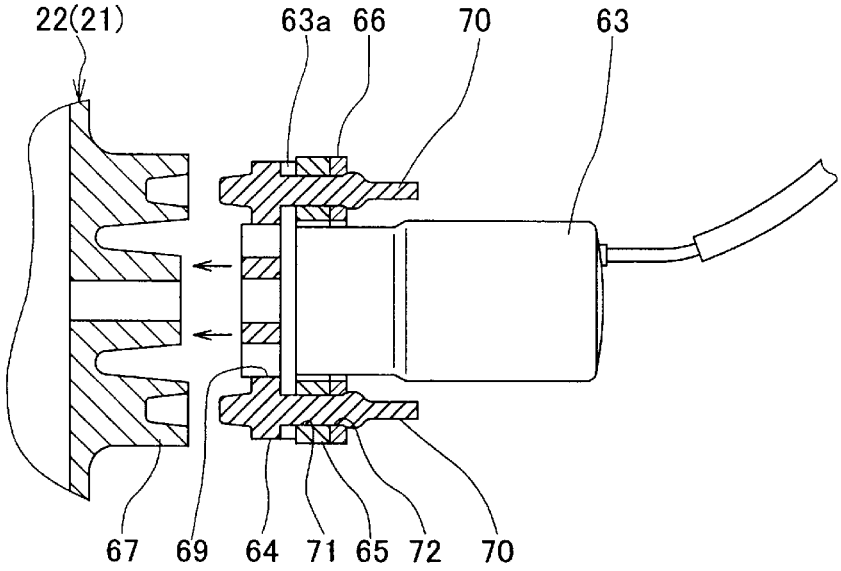
FIG. 10 is a sectional view taken along the line X—X of FIG. 7.
Figure 11:
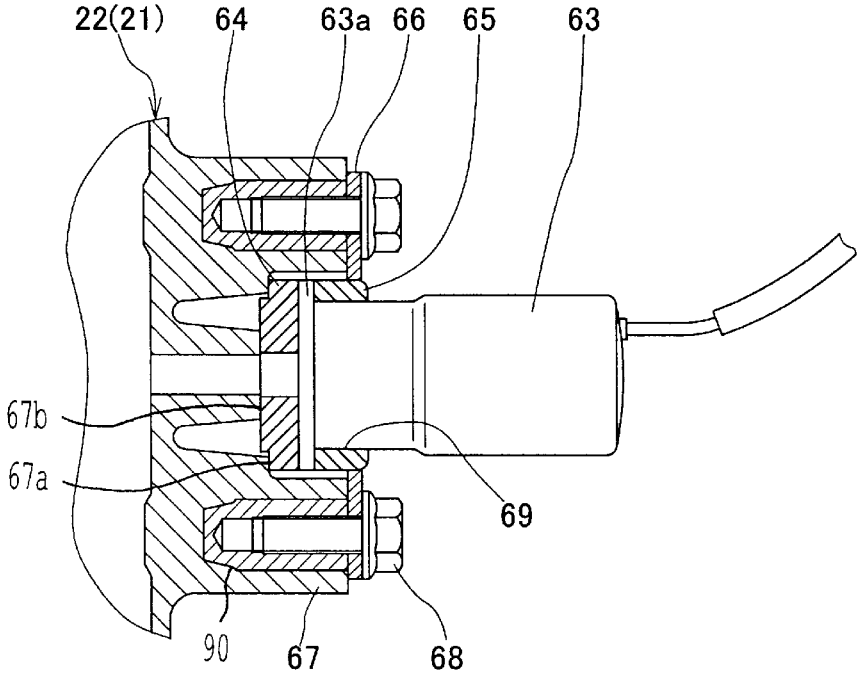
FIG. 11 is a sectional view taken along the line XI—XI of FIG. 7.

FIG. 10 is a sectional view taken along the line X—X of FIG. 7, and FIG. 11 is a sectional view taken along the line XI—XI of FIG. 7. As shown in FIGS. 10 and 11, the flange 63*a* of the IAC valve 63 held between a pair of elastic elements, e.g., the first rubber sheet 64 and the second rubber sheet 65. These rubber sheets 64 and 65 are attached to a valve holder 66 made of sheet metal in a full or completely floating state. This valve holder 66 is fixed to a valve mounting boss 67 formed at the surge tank 22 by, for example, means of bolts 68 so that the edge of the valve holder 66 does not abut on the resin surface.

As shown in FIG. 11, a threaded member 90 is mounted to the valve mounting boss 67 and the bolt 68 screw engages the valve holder 66 with the threaded member 90 for the fastening between the valve mounting boss 67 and the valve holder 66. Further, the valve mounting boss 67 is provided with portions 67*a* and 67*b*, which abut against the mating surface of the first rubber sheet 64 in the assembled state.

Further, the first rubber sheet 64, the second rubber sheet 65 and the valve holder 66 are integrated with one another while being assembled with the IAC valve 63. To be specific, a pair of engagement protrusions 70 is provided at the first rubber sheet 64 with the insertion hole 69 of the IAC valve 63 held therebetween. Engagement holes 71, into which the engagement protrusions 70 are engageable, are formed in the second rubber sheet 65. The engagement protrusions 70 are engaged with the engagement holes 71 while the flange 63*a* of the IAC valve 63 is held between the protrusions 70, thereby integrating these rubber sheets 64 and 65 with the IAC valve 63. Further, engagement holes 72, into which the tip end portions of the engagement protrusions 70 can be engaged, are also formed in the valve holder 66 and the tip end portions of the engagement protrusions 70 integrated with the IAC valve 63 are engaged with the holes 72, whereby the IAC valve 63 is held in the valve holder 66 in a full floating state.

Figure 12:
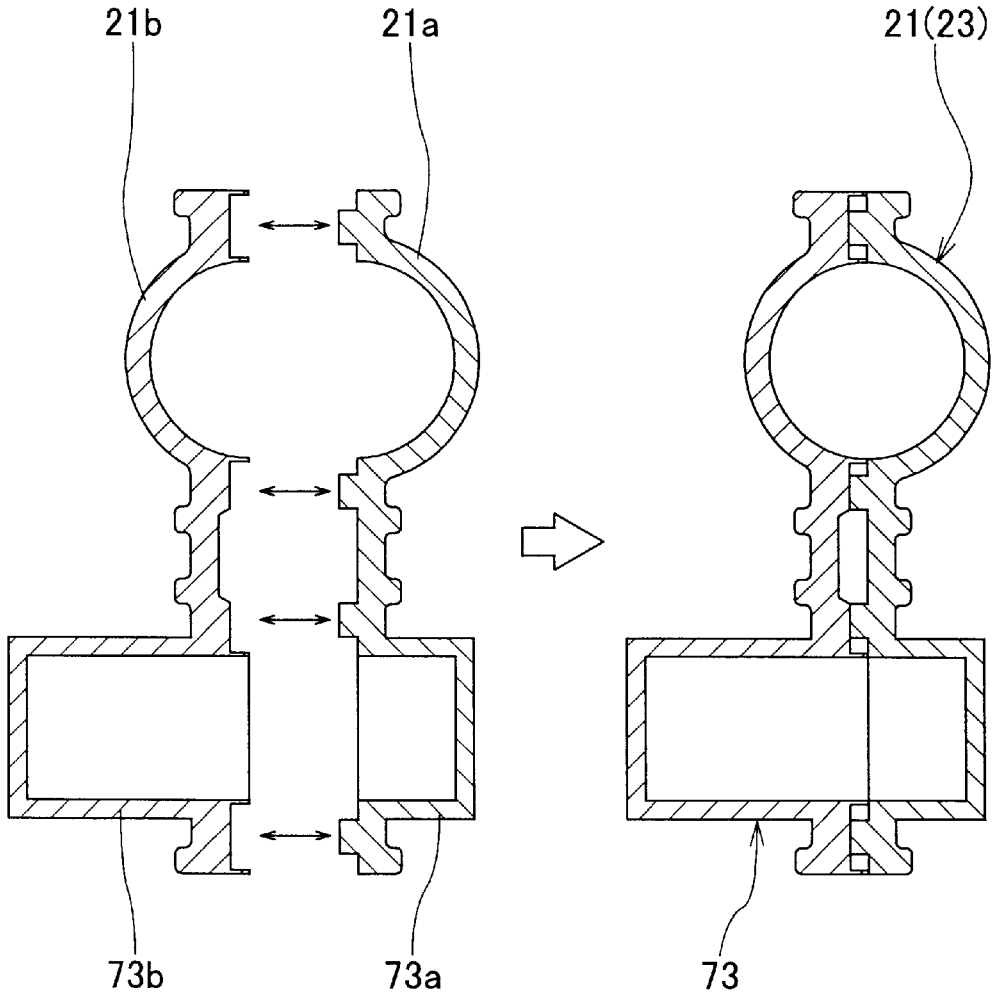
FIG. 12 is a sectional view taken along the line XII—XII of FIG. 4.

On the other hand, the IAC valve 63 is provided with a valve silencer 73 for eliminating the valve operating noise of the IAC valve 63. FIG. 12 is a sectional view taken along the line XII—XII of FIG. 4 and shows the cross-section of the valve silencer 73. As shown in FIGS. 4 and 12, the valve silencer 73 is provided on the lower surface of the intake manifold 21, and the valve silencer 73 is laterally halved into halves 73*a* and 73*b*, which are formed integrally with the outside shell 21*a* and the inside shell 21*b*, respectively. Accordingly, the valve silencer 73 takes the form of an expansion chamber when both the shells 21*a* and 21*b* are coupled together.

An intake hose 74 connected to the valve silencer 73 on the upstream side extends to the side of the vapor separator 29 while extending above the intake manifold 21. A supply hose 75 connected to the valve silencer 73 on the downstream side is connected to an intake union 76 provided in the vicinity of the IAC valve 63. It is noted that the intake hose 74 is held by a hose clamp 50 provided on the upper surface of the intake manifold 21.

Figure 6:
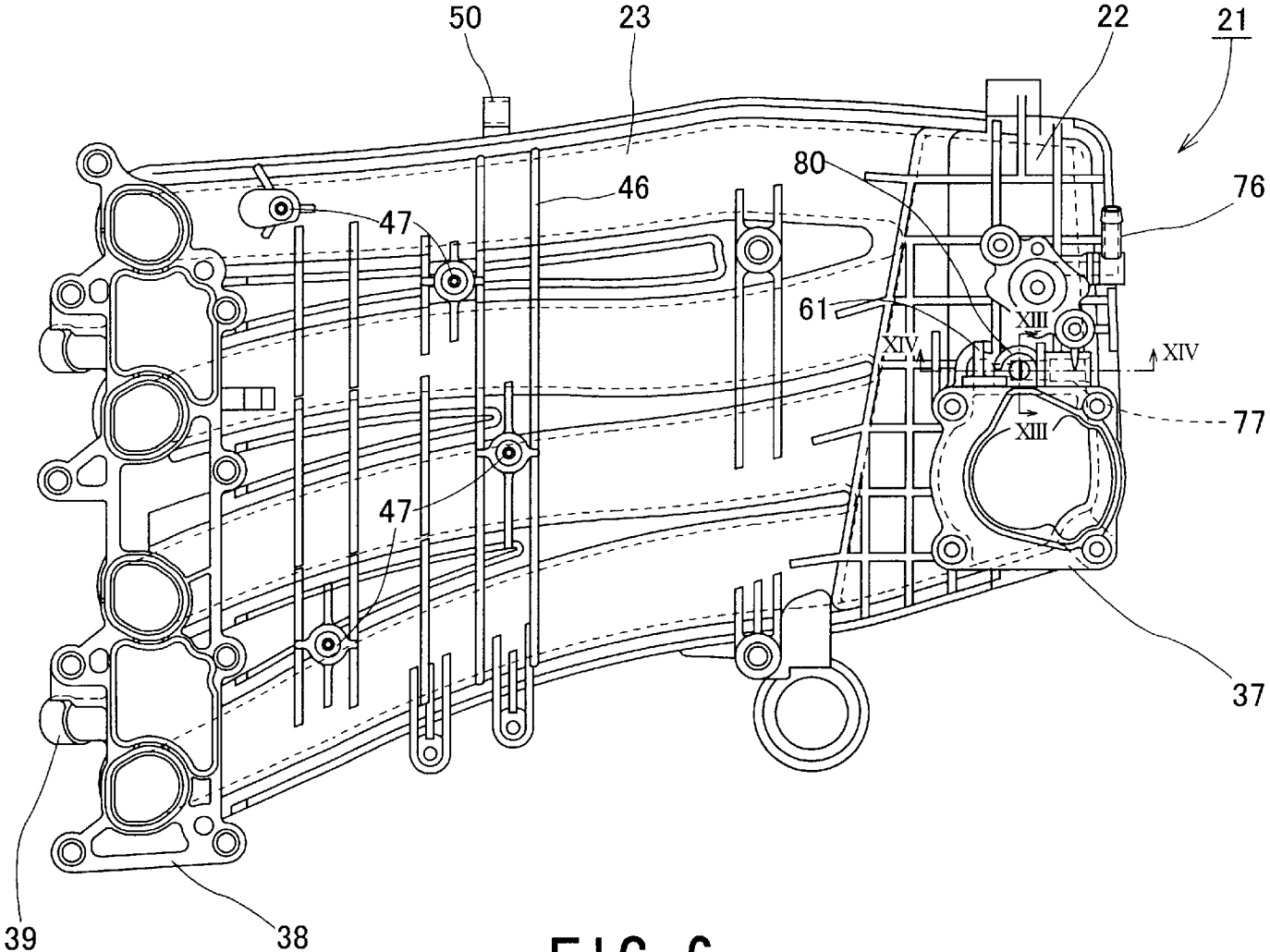
FIG. 6 is a right side view of only the intake manifold.
Figure 13:
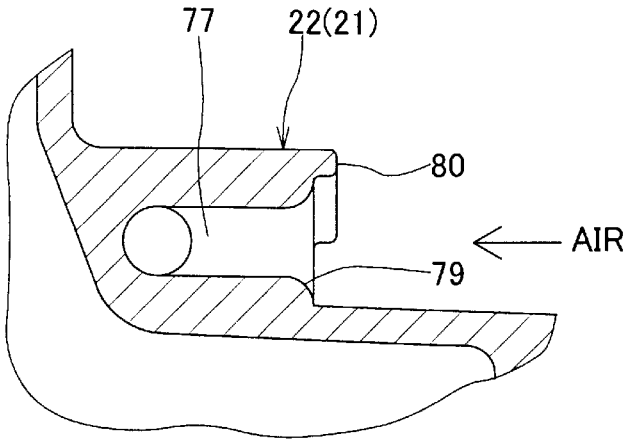
FIG. 13 is a sectional view taken along the line XIII—XIII of FIG. 6.
Figure 14:
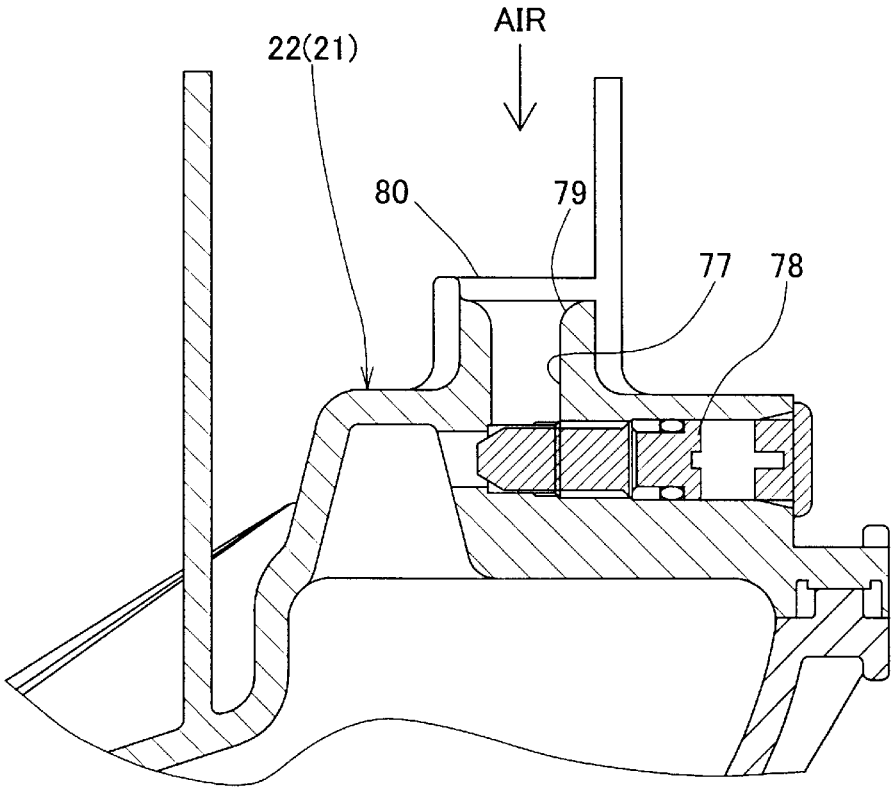
FIG. 14 is a sectional view taken along the line XIV—XIV of FIG. 6.

FIG. 13 is a sectional view taken along the line XIII—XIII of FIG. 6, and FIG. 14 is a sectional view taken along the line XIV—XIV of FIG. 6. As shown in FIGS. 6, 13 and 14, a by-pass passage 77 for regulating the quantity of air flowing through the IAC valve 63 is disposed below the IAC valve 63 provided for the surge tank 22 to be integral with the intake manifold 21. A screw 78 is provided in the middle of the by-pass passage 77 and the inlet of the by-pass passage 77 is formed into a funnel shape 79 expanding outward. A hood-like protrusion 80 is provided integrally with the bypass passage 77 above the inlet of the passage 77.

Next, the function of this embodiment will be described.

The IAC valve 63 regulating the quantity of intake air into the intake manifold body 21 in an idling state is attached to the valve holder 66 of sheet metal by the first rubber sheet 64 and the second rubber sheet 65 which are elastic elements in a full floating state. Accordingly, the operating vibration of the IAC valve 63 can be absorbed by the rubber sheets 64 and 65 and the generation of noise from the intake manifold 21 can be completely prevented.

Further, since the valve holder 66 is fixed to the valve mounting boss 67 of the surge tank 22 while preventing the edge portion of the valve holder 66 from abutting against the resin surface, the resin surface of the intake manifold 21 can be prevented from being damaged.

Moreover, both the rubber sheets 64 and 65 and the valve holder 66 are integrated with one another while being assembled with the IAC valve 63, so that the assembling working of the IAC valve 63 to be assembled with the intake manifold 21 can be improved. Further, it is to be noted that the integrated structure of these members, in a state of being assembled with the IAC valve 63, will be also applied to an intake manifold made of aluminum alloy.

Further, the axis 60*a* of the pressure sampling hole 60 formed in the surge tank 22 and the axis 62*a* of the passage 62 formed in the pressure hose connection union 61 attached to the pressure sampling hole 60 are arranged in a manner being offset from each other. According to this arrangement, the interior of the pressure hose connection union 61 functions as a kind of a separator to thereby prevent fuel or lubricant contained in the intake manifold from entering the pressure sensor. As a result, filter means which has been conventionally employed can be eliminated from location, and the number of parts and the number of assembling steps can be, therefore, reduced. Besides, it becomes unnecessary to provide the intake manifold 21 with screws or the like and cost reduction can be realized.

In addition, the inlet of the by-pass passage 77 for regulating the quantity of air flowing in the IAC valve 63 is formed into the funnel shape 79 expanding outward, whereby air intake noise can be reduced. The integral provision of the hood-like protrusion 80 above the inlet of the by-pass passage 77 makes it possible to prevent seawater passing along the wall of the surge tank 22 from entering the intake manifold 21.

Consequently, it is possible to eliminate a brass union which has been conventionally employed to thereby reduce the number of parts and the number of assembling steps without hampering the function of the intake manifold.

Besides, the valve silencer 73 provided on the lower surface of the intake manifold 21 is laterally halved into halves 73*a* and 73*b*, which are formed integrally with the outside shell 21*a* and the inside shell 21*b* of the intake manifold body 21, respectively, thus constituting the valve silencer 73 to take the form of an expansion chamber at the time of coupling the shells 21*a* and 21*b* together. According to such structure, it is possible to reduce the number of parts and the number of assembling steps and to eliminate the attachment of the valve silencer to the intake manifold 21.

Further, it is to be noted that the present invention is not limited to the described embodiment and many other changes, modifications and alternations may be made without departing from the scopes of the appended claims.

That is, for example, in the above-stated embodiment, description has been given while taking a case of applying the present invention to an in-line four-cylinder engine as an example. As long as the engine is a multiple-cylinder engine, the in-line four-cylinder engine may be replaced with an engine of three or less cylinders or five or more cylinders or replaced with a V-type engine. In addition, in the above-stated embodiment, description has been given while taking a case of halving the intake manifold 21 as an example. Alternatively, by dividing the intake manifold 21 into three or four segments, the present invention can be applied to an intake manifold having a more complex shape or more complex structure.

In the above-stated embodiment, description has been given while taking a case of fixing the intake manifold 21 to the cylinder head 6 and the crankcase 8 as an example. Alternatively, the intake manifold 21 may be fixed to the cylinder block 7. In the above-stated embodiment, description has been given while taking a case of fixing the intake manifold 21 to the crankcase 8 through the bracket 51 attached to the throttle body 20 as an example. Alternatively, the bracket may be directly attached to the intake manifold 21. Furthermore, instead of employing the bracket 52, a boss, not shown, for example, may be provided on the engine side, and the intake manifold 21 and the throttle body 20 may be mounted to this boss.

What is claimed is:

1. An intake manifold unit for an outboard motor mounting a multiple-cylinder engine having cylinders to which intake air is distributed through the intake manifold unit of an intake unit, said intake manifold unit comprising:

an intake manifold body formed of a synthetic resin;

an idling air control (IAC) valve for regulating a quantity of intake air into the intake manifold body in an idling operation state;

a valve holder to which the IAC valve is operatively connected in a floating manner;

an elastic member through which the IAC valve is mounted to the valve holder, said IAC valve, said elastic member and said valve holder being coupled integrally with each other and mounted to the intake manifold body in the floating state; and a threaded member is mounted to a valve mounting boss of the intake manifold body and a bolt that screw engages the valve holder with the threaded member, the valve mounting boss being provided with portions which abut against a mating surface of the elastic member in an assembled state of the valve mounting boss.

2. An intake manifold unit according to claim 1, wherein said intake manifold body comprises a surge tank disposed downstream side of a throttle body of the intake unit and a branch extending from the surge tank and operatively connected to the engine, said surge tank being provided with a valve mounting boss to which said valve holder is mounted.

3. An intake manifold unit according to claim 1, wherein said IAC valve is provided with a flanged portion, said elastic member is composed of first and second rubbers between which the flanged portion is clamped and to which the valve holder made of metal plate is mounted in the floating manner.

4. An intake manifold unit according to claim 1, wherein the intake manifold body is formed with a pressure sampling hole, to which a pressure hose connection union is mounted, said pressure hose connection union is operatively connected to a pressure sensor for an outboard motor in a manner that an axis of the pressure sampling hole is arranged to be offset from an axis of a passage formed in said union.

5. An intake manifold unit according to claim 1, wherein said intake manifold body is provided with a by-pass passage for regulating a quantity of air flowing in the IAC valve, said by-pass passage being provided with an inlet formed so as to provide a funnel shape expanding outward, and a hood-shape protrusion is integrally formed above the inlet of the by-pass passage.

6. An intake manifold unit according to claim 1, wherein said intake manifold body is formed to be dividable and further provided with a valve silencer for the IAC valve, said valve silencer is being divided into halves, which are integrally formed with divided portions of the intake manifold unit, respectively, so as to provide an expansion chamber when the divided portions of the intake manifold body are coupled with each other.

7. An intake manifold unit according to claim 6, wherein said manifold body is divided into two parts of inside shell and outside shell to which said halves of the divided valve silencer are integrally coupled respectively.

8. An intake manifold unit for an outboard motor mounting a multiple-cylinder engine having cylinders to which intake air is distributed through the intake manifold unit of an intake unit, said intake manifold unit comprising:

an intake manifold body formed of a synthetic resin;

an idling air control (IAC) valve for regulating a quantity of intake air into the intake manifold body in an idling operation state;

a valve holder to which the IAC valve is operatively connected in a floating manner; and an elastic member through which the IAC valve is mounted to the valve holder, said IAC valve, said elastic member and said valve holder being coupled integrally with each other and mounted to the intake manifold body in the floating state, wherein the intake manifold body is formed with a pressure sampling hole, to which a pressure hose connection union is mounted, said pressure hose connection union is operatively connected to a pressure sensor for an outboard motor in a manner that an axis of the pressure sampling hole is arranged to be offset from an axis of a passage formed in said union.

9. An intake manifold unit for an outboard motor mounting a multiple-cylinder engine having cylinders to which intake air is distributed through the intake manifold unit of an intake unit, said intake manifold unit comprising:

an intake manifold body formed of a synthetic resin;

an idling air control (IAC) valve for regulating a quantity of intake air into the intake manifold body in an idling operation state;

a valve holder to which the IAC valve is operatively connected in a floating manner; and an elastic member through which the IAC valve is mounted to the valve holder, said IAC valve, said elastic member and said valve holder being coupled integrally with each other and mounted to the intake manifold body in the floating state, wherein said intake manifold body is provided with a by-pass passage for regulating a quantity of air flowing in the IAC valve, said by-pass passage being provided with an inlet formed so as to provide a funnel shape expanding outward, and a hood-shape protrusion is integrally formed above the inlet of the by-pass passage.

* * * * *